US005829315A

United States Patent [19]

Polowchak et al.

[11] Patent Number: 5,829,315

[45] Date of Patent: Nov. 3, 1998

[54] TWO AXIS LINEAR ACTUATION MECHANISM

[75] Inventors: John L. Polowchak; Michael A. Sandford; Daniel W. Brunton; Lewis P. Lane, all of Tucson, Ariz.

[73] Assignee: Raytheon Company, Los Angeles, Calif.

[21] Appl. No.: 734,616

[22] Filed: Oct. 11, 1996

[51] Int. Cl.[6] ..... G05G 5/06

[52] U.S. Cl. ..... 74/527; 74/471 R

[58] Field of Search ..... 74/527, 471 R

[56] References Cited

U.S. PATENT DOCUMENTS

| | | | |
|---|---|---|---|
| 3,618,635 | 11/1971 | Allen | 74/527 X |
| 3,986,701 | 10/1976 | Hopkins | 74/527 X |
| 4,278,156 | 7/1981 | Yano et al. | 74/527 X |
| 4,454,785 | 6/1984 | Purrer | 74/471 R X |

*Primary Examiner*—Charles A. Marmor
*Assistant Examiner*—Mary Ann Battista
*Attorney, Agent, or Firm*—Brian C. Downs; Leonard A. Alkov; Glenn H. Lenzen, Jr.

[57] ABSTRACT

Actuation apparatus for linearly engage and disengage pins respectively disposed along two predetermined (orthogonal) axes using a single actuator. The actuation apparatus comprises a housing and the actuator, which may comprise a DC torquer motor disposed in the housing. The actuator or motor has a threaded rotary shaft. A common plunger is coupled to the threaded rotary shaft that has an elevation ramp formed therein. Azimuth and elevation actuation pins are disposed along the predetermined axes within the housing that are moveable and extend outside the housing and retract into the housing when selectively actuated. Azimuth and elevation springs are disposed around the azimuth and elevation actuation pin. In a preferred embodiment, the pins are extendable into and removable from slots disposed in a moveable gimbal of a missile seeker, and locks an antenna disposed on the gimbal.

12 Claims, 1 Drawing Sheet

TWO AXIS LINEAR ACTUATION MECHANISM

BACKGROUND

The present invention relates generally to actuators, and more particularly, to actuation apparatus for linearly engaging and disengaging two pins in orthogonal axes using a single actuator.

Of some importance to aircraft is their "stealthiness" with respect to their radar signature. Consequently, efforts have been made to reduce the radar signature of aircraft. More recently there has been interest in reducing the radar signature of missiles that the aircraft carry. A study was performed by the assignee of the present invention to find ways to reduce the radar signature of an AMRAAM missile.

In the case of the AMRAAM missile, the antenna in its seeker has a large radar signature. One way to reduce the radar signature of the antenna is to point the antenna off-axis when it is not in use. To accomplish this, a mechanism is needed to lock the seeker at a selectable arbitrary look angle. To complicate this design task, there are a number of demanding requirements such as size, power, actuation time, cost, and reliability, for example.

A search for a commercial "off-the-shelf" actuator revealed no solutions. These devices include magnetic solenoid actuators, electromechanical actuators, rotary actuators, pneumatic actuators and hydraulic actuators. However, no commercially available actuator was found that is capable of linearly engaging and disengaging two pins in orthogonal axes. Furthermore, disadvantages of prior art actuators are that power is required for one or both engaged or disengaged states, the devices required complex control systems, and some devices require working fluids. Furthermore, available actuators have excessive actuation time, spring loaded actuation pins are not available, devices that provide unpowered positive locking in engaged and disengaged states are not available, and suitable miniature actuators are not available.

Therefore, a design study was initiated to construct a device meeting all known requirements for the missile. The result of that design study is the actuation apparatus described herein. Accordingly, it is an objective of the present invention to provide actuation apparatus for linearly engaging and disengaging two pins in orthogonal axes using a single actuator and which is unpowered in both engaged and disengaged states.

SUMMARY OF THE INVENTION

To meet the above and other objectives, the present invention provides for actuation apparatus that is used to linearly engage and disengage two pins respectively disposed in orthogonal axes using a single actuator (DC torque motor). The actuation apparatus comprises a housing and a DC torquer motor having a threaded rotary shaft disposed in the housing. A common plunger is coupled to the threaded rotary shaft that has an elevation ramp formed therein. Azimuth and elevation actuation pins are disposed along predetermined (orthogonal) axes within the housing that are moveable and extend outside the housing and retract into the housing when selectively actuated. Azimuth and elevation springs are disposed around the azimuth and elevation actuation pin. In a preferred embodiment, the pins are extendable into and removable from slots disposed in a moveable gimbal of a missile seeker, and locks an antenna disposed on the gimbal.

The actuation apparatus is extremely compact and may be used where there are severe space limitations. The actuation apparatus is unpowered and locks in both the engaged and disengaged positions, requiring power only when the device is being engaged or disengaged. Engagement of each pin is spring loaded and is independent of each other. As an alternative configuration, brake pads may be attached to the spring loaded pins and on the mating interface to create a frictional brake/clutch arrangement.

The actuation apparatus is unpowered in engaged and disengaged states, has a positive locking action in both the engaged and disengaged states. Only one actuator is required to engage and disengage pins in two axes, and actuation time is short. The apparatus may be scaled to any size, and power and signal leads are simple to implement. The pins provide positional forgiveness, are spring loaded in the engaged position, and pin engagements are independent of each other. Engagement forces can be controlled closely through selection of the springs, command logic required for operation is simple, providing a fixed time application of power, and the motor has large mechanical advantage thus reducing size and required power. The apparatus may be used with any seeker platform utilizing a "knuckle"(Hooke's joint). The apparatus may also be used in situations where a compact linear actuator in two axes is needed.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
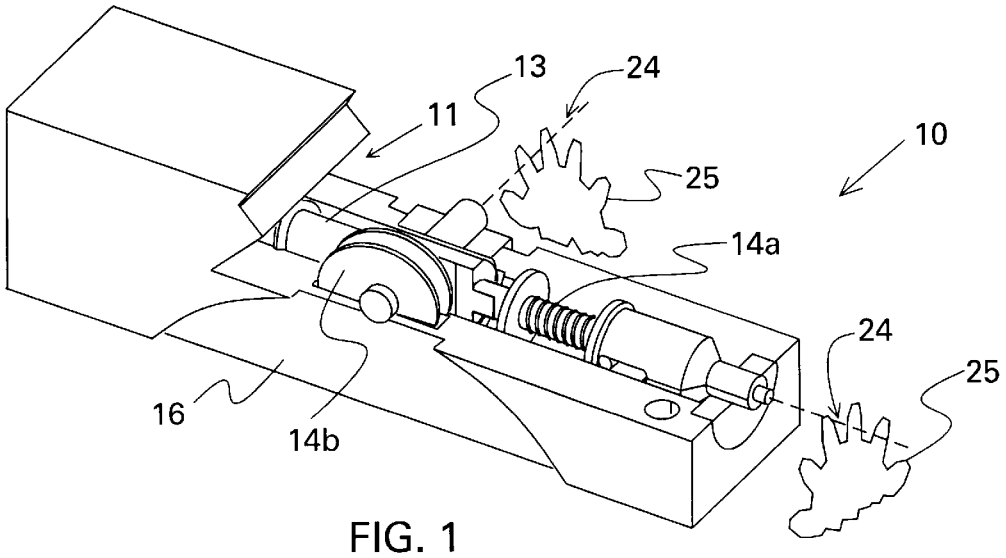
FIG. 1 is a partially cutaway perspective view of an actuation apparatus in accordance with the principles of the present invention for linearly engaging and disengaging two pins in orthogonal axes.
Figure 2:
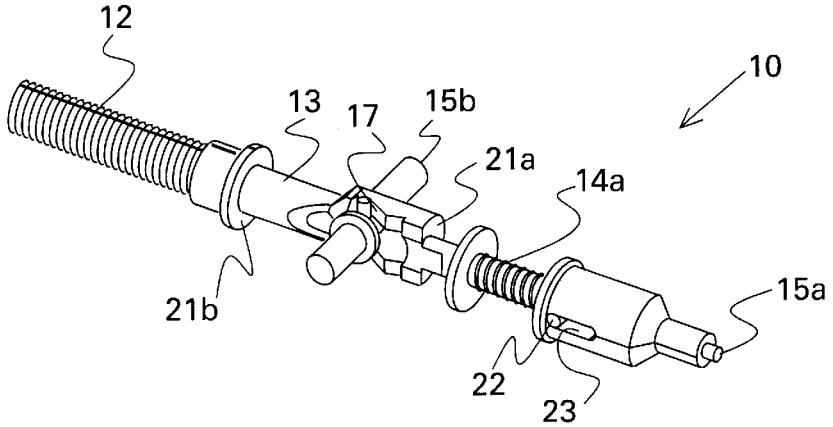
FIG. 2 illustrates a perspective view of the working components of the actuation apparatus of FIG. 1.

Referring to the drawing figures, FIG. 1 shows a partially cutaway perspective view of an actuation apparatus 10 in accordance with the principles of the present invention while FIG. 2 shows the working components of the actuation apparatus 10. The actuation apparatus 10 provides a means for linearly engaging and disengaging two pins 15*a*, 15*b*, or azimuth and elevation pins 15*a*, 15*b*, disposed along orthogonal axes. The actuation apparatus 10 is comprised of a housing 16 that is secured to an actuator 11, comprising a DC torquer motor 11, having a threaded rotary shaft 12. A common plunger 13 is connected to the threaded rotary shaft 12 and has an elevation ramp 17 formed therein.

The two actuation pins 15*a*, 15*b*, comprising the azimuth and elevation pins 15*a*, 15*b*, are disposed along orthogonal axes within the housing 16 and are moveable so that they can extend outside the housing 16 when actuated. The pins 15*a*, 15*b* extend into slots 24 disposed in moveable or rotatable plates 25, such as may be part of torque motors of a gimbal 25 disposed on a missile seeker, for example. A plurality of azimuth springs 14*a* and elevation springs 14*b* are disposed around the respective actuation pins 15*a*, 15*b*. A plurality of fasteners, (not shown), such as screws, for example, are used to secure the various components to the housing 16.

Operation of the actuation apparatus 10 begins when the motor 11 turns and axially drives the common plunger 13 toward the azimuth pin 15*b* by way of the threaded rotary shaft 12. The movement of the common plunger 13 in turn drives the azimuth pin 15*a*. The common plunger 13 also drives the orthogonal elevation pin 15*b* by means of the elevation ramp 17. In both axes, engagement forces are transmitted through the springs 14*a*, 14*b* which control pin forces and allow for positive retraction of the pins 15*a*, 15*b*.

The detailed operation of the actuation apparatus 10 is as follows. During engagement, power is supplied for a discrete amount of time to the DC torquer motor 11. The motor 11 turns the threaded rotary shaft 12, and as the rotary shaft 12 turns, it drives the common plunger 13 forward toward the azimuth pin 15*a*. As the common plunger 13 moves forward, the two actuator pins 15*a*, 15*b* are driven forward in the following manner.

The azimuth pin 15*a* is driven forward directly by the common plunger 13 via the azimuth spring 14*a* that is in contact with it. The elevation pin 15*b* is driven forward by way of the elevation ramp 17 on the common plunger 13 and the force exerted by the elevation spring 14*b*. Because both actuator pins 15*a*, 15*b* are spring loaded, they need not immediately engage into the slots 24. The azimuth and elevation pins 15*a*, 15*b* independently engage the slots 24.

The motion of the common plunger 13 ceases when it reaches a forward mechanical stop 21*a*. Power to the DC torquer motor 11 is then discontinued. A negative slope on the elevation ramp 17 provides a positive lock when the common plunger 13 is in an engagement state with power to the motor 11 off.

During disengagement, power is supplied to the motor 11 which has a voltage opposite to the voltage applied during engagement, and the motor 11 turns the rotary shaft 12 in a direction opposite to the rotational direction during engagement. As the rotary shaft 12 rotates, its threaded portion drives the common plunger 13 backwards, away from the azimuth pin 15*a*.

As the common plunger 13 moves backward, the two pins 15*a*, 15*b* are driven backwards in the following manner. The azimuth pin 15*a* is driven back directly by a slot 22 and pin 23 (shown in FIG. 2). The elevation pin 15*b* is driven back by the elevation ramp 17 on the common plunger 13. Both pins 15*a*, 15*b* are positively retracted regardless whether they are engaged or not.

The motion of the common plunger 13 ceases when it reaches a rear mechanical stop 21*b*. Power to the DC torquer motor 11 is then discontinued. The spring force provides a positive lock when the common plunger 13 is in the disengagement state with power to the motor 11 off.

The actuation apparatus 10 has been designed for use as a gimbal constraint mechanism that allows for a large selection of constraint angular locations for a missile antenna with the addition of two cross-gimbal wires that are used to provide power and control the motor 11 and with minimal on-gimbal mass and inertia impact. The actuation apparatus 10 engages slots 24 that are used to lock motion of both gimbal axes and replaces a counterweight normally disposed on a forward side of the torquer motor 11. The actuation apparatus 10 may be used to lock the gimbal over its entire angular movement range.

The actuation apparatus 10 provides a means for locking an antenna disposed on the gimbal in a desired position or at different positions in the angular range of motion of the gimbal with a resolution or least significant bit of about five degrees. The pins 15*a*, 15*b* engage the slots 24 on plates 25 secured to the gimbal torque motors, which retain the antenna in a locked position. The pins 15*a*, 15*b* are pushed forward into the slots 24 in the gimbal torque motors. The minimum center-to-center spacing of the slots 24 has an equivalent pitch of five degrees. However, the slot pitch may also be optimized for particular locations. The tolerances of the location of the pins 15*a*, 15*b* and engagement slots increase inaccuracy. To achieve a pitch of 5 degrees and not change seeker positional tolerance, the gimbal is commanded to a nominal position between two slots 24. The tolerance buildup is designed to guarantee impact either between or in one of two adjacent slots 24. The spring forces on the pins 15*a*, 15*b* are such that the pins 15*a*, 15*b* do not skip slots 24.

Detailed parameters relating to components of the apparatus 10 are listed below:

| Component | Parameter |
|---|---|
| Size | 1.46 inches × 0.3825 inches × 0.425 inches |
| Mass | 19 grams |
| Material: | Pins: hardened steel, housing: titanium, steel |
| Slots: | 0.030 inches in depth |
| Pins: | 0.025 inches long, 0.03125 inches in diameter |
| Motor nominal torque | 0.6 in-oz at 35 volts |
| Torque to overcome friction | 0.19 in-oz |
| Coefficient of friction (assumed) | 0.1 |
| Common plunger travel | 0.080 inches |
| Slide angle for elevation axis pin | 40 degrees |
| Spring types: | Belleville washers, wave washers, compression. |

Thus, actuation apparatus for linearly engaging and disengaging pins disposed in orthogonal axes using a single actuator has been disclosed. It is to be understood that the described embodiment is merely illustrative of some of the many specific embodiments which represent applications of the principles of the present invention. Clearly, numerous and varied other arrangements may be readily devised by those skilled in the art without departing from the scope of the invention.

What is claimed is:

1. Actuation apparatus comprising:

a housing;

a torquer motor having a threaded rotary shaft disposed in the housing;

a common plunger coupled to the threaded rotary shaft that has an elevation ramp formed therein;

azimuth and elevation actuation pins disposed along predetermined axes within the housing that are moveable so as to extend outside the housing and retract into the housing when selectively actuated;

an azimuth spring disposed around the azimuth actuation pin; and an elevation spring disposed around the elevation actuation pin.

2. The apparatus of claim 1 wherein the predetermined axes are orthogonal to each other.

3. The apparatus of claim 1 wherein the azimuth spring comprises a plurality of springs.

4. The apparatus of claim 1 wherein the elevation spring comprises a plurality of springs.

5. The apparatus of claim 1 wherein the torquer motor comprises a direct current torquer motor.

6. The apparatus of claim 1 wherein the pins are extendable into and removable from slots disposed in a moveable gimbal torque motor plate.

7. The apparatus of claim 6 wherein the gimbal torque motor plate is rotatable.

8. Actuation apparatus for selectably locking and unlocking a moveable gimbal torque motor plate, said plate provided with slots, said apparatus comprising:

a housing;

a torquer motor having a threaded rotary shaft disposed in the housing;

a common plunger coupled to the threaded rotary shaft that has an elevation ramp formed therein;

azimuth and elevation actuation pins disposed along predetermined axes within the housing that are moveable so as to extend outside the housing and retract into the housing when selectively actuated, and wherein the pins selectively engage the slots in the moveable gimbal torque motor plate;

an azimuth spring disposed around the azimuth actuation pin; and an elevation spring disposed around the elevation actuation pin.

9. The apparatus of claim 8 wherein the azimuth spring comprises a plurality of springs.

10. The apparatus of claim 8 wherein the elevation spring comprises a plurality of springs.

11. The apparatus of claim 8 wherein the torquer motor comprises a direct current torquer motor.

12. The apparatus of claim 8 wherein the predetermined axes are orthogonal to each other.

* * * * *